US006154179A

United States Patent [19]

Kohno

[11] Patent Number: 6,154,179

[45] Date of Patent: Nov. 28, 2000

[54] UNDERGROUND OR UNDERWATER ANTENNAS

[76] Inventor: Kazuo Kohno, 332-30 Shitengi, Ohami Shirasato-machi, Sanbu-gun, Chiba-pref., Japan

[21] Appl. No.: 09/179,867

[22] Filed: Oct. 28, 1998

[30] Foreign Application Priority Data

Nov. 28, 1997 [JP] Japan ..... 9-344031

[51] Int. Cl.[7] ..... H01Q 1/34; H01Q 1/04

[52] U.S. Cl. ..... 343/719; 343/709; 343/895; 343/873

[58] Field of Search ..... 343/709, 700 MS, 343/895, 719, 873, 872; H01Q 1/34, 1/04

[56] References Cited

U.S. PATENT DOCUMENTS

| | | | |
|---|---|---|---|
| 4,376,941 | 3/1983 | Zenel | 343/709 |
| 4,821,040 | 4/1989 | Johnson et al. | 343/789 |
| 5,406,294 | 4/1995 | Silvey et al. | 343/709 |
| 5,898,405 | 4/1999 | Iwasaki | 343/700 MS |

*Primary Examiner*—Hoanganh Le
*Attorney, Agent, or Firm*—Wenderoth, Lind & Ponack, L.L.P.

[57] ABSTRACT

A high dielectric is fixed to the side of an opening of a casing made from a good electroconductive material or is fixed to the side of an opening of an outer shell made from an insulator such as ferrite, and an antenna element is fixed on the back surface of the high dielectric. A material body, which has a small relative dielectric constant such as air is stored in the casing or the outer shell. The antenna element is sandwiched between the material body having the small relative dielectric constant and the high dielectric. The high dielectric is formed from a material having a relative dielectric constant that is close to the relative dielectric constant of a medium material such as clay, sand, water and the like in the underground or the underwater. When the electromagnetic wave is transmitted to the underground or the underwater or the electromagnetic wave is received from the underground or the underwater, the casing or the outer shell is buried in the underground or the underwater or is caused to approach the underground or the underwater.

16 Claims, 9 Drawing Sheets

UNDERGROUND OR UNDERWATER ANTENNAS

BACKGROUND OF THE INVENTION

The present invention relates to underground or underwater antennas which are used for transmitting electromagnetic waves underground, underwater or in the inside of a concrete structure, or receiving electromagnetic waves from underground, underwater or the inside of the concrete structure by causing such antennas to be buried in, contacted or approached in the underground, underwater or concrete structure.

A conventional underground antenna is constructed as shown in FIG. 9 wherein elements (6) are supported in a metal casing (2) by means of a support member (4). Transfer wheels are mounted on the casing (2), and only a surface in contact with a ground (10) is open. The electromagnetic waves transmitted from the antenna elements (6) are radiated once into the air and are caused to come to the underground.

As underground radar, it has been hoped recently for an underground (underwater) antenna to be used for investigating correctly the location and condition of city water pipes, gas pipes, sewage pipes, electric wires buried underground, or measuring bearing power of the soil by the condition of echoes from the underground, or the discovery of an underground water vein. Furthermore, it has been desired to obtain an antenna that can be used for discovering pinholes in materials such as water or concrete columns and the like or for reception of electromagnetic waves coming from the underground efficiently in order to forecast earthquakes. Still furthermore, it has been desired to provide an antenna capable of detecting land mines and living body reactions of a person buried in tiles and pebbles at a calamity or a person buried in snow at a snowslide. Heretofore, when an electromagnetic wave enters into the ground or another physical body, as described in the foregoing, an aerial antenna for use above the ground is brought into practice, but because of the adoption of irrational methods such as forcing the electromagnetic wave into the ground by all means, its efficiency is poor, and moreover, there is still another problem in that this antenna does not function normally even if it is buried in the underground. Furthermore, a study has been conducted to make use of the electromagnetic waves (electric wave, electric field, magnetic field) coming from a source of earthquake when an earthquake occurs by receiving the waves with an aerial antenna above ground to forecast the earthquake. However, in the air, a variety of electromagnetic waves (artificial noise, natural noise) are in existence, and this presents a rather difficult problem.

SUMMARY OF THE INVENTION

It is desirable that the dielectric is made of a material having a relative dielectric constant closer to the relative dielectric constant of a medium body of clay, sand, water and the like in the underground, underwater and the like which come into contact with the antenna.

Furthermore, the present invention may be constructed of a high dielectric that is cylindrical in shape, and an antenna element and a low dielectric are disposed inside of the high dielectric, and the whole body may be shaped like a bar.

Furthermore, the present invention is constructed in such a way that a casing is formed from a good electroconductive material, and a high dielectric is fixed to an opening side of the casing, and the antenna element is disposed at the back surface of the high dielectric. In the casing, a material having small relative dielectric constant such as air is stored in the casing, and the antenna element is sandwiched between the material having the small dielectric constant and the high dielectric. A magnetic material may be disposed inside of the casing.

The present invention, still furthermore, is constructed in such a way that an outer shell is made of resin that contains ferrite or a ferrite sintered body, and a high dielectric is fixed to the open side of the outer shell, and the antenna element is disposed at the back surface of the high dielectric. A material having a small relative dielectric constant such as air is stored in the outer shell, and the antenna element is sandwiched between the material having the small relative dielectric constant and the high dielectric.

Yet furthermore, the present invention is constructed in such a way that a printed substrate made of a glass epoxy plate is fixed to the side of back surface of the high dielectric, and the antenna element is formed on one surface of the printed substrate by etching, and the antenna element is sandwiched between the high dielectric and the printed substrate.

The present invention is constructed as described in the foregoing so that it has the effect of enabling the efficient absorption of the electromagnetic waves underground or underwater and also enabling the absorption of the electromagnetic waves from underground or underwater.

DETAILED DESCRIPTION OF THE INVENTION

The construction of the present invention will now be described in detail by referring to the embodiments of the present invention shown in the attached drawings.

Figure 1:
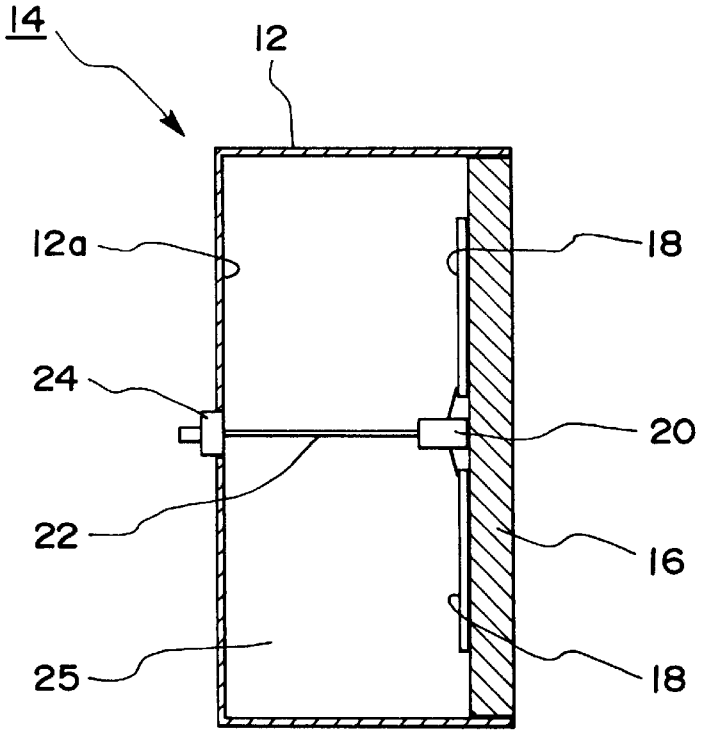
FIG. 1 is a cross section of a device according to the present invention.
Figure 2:
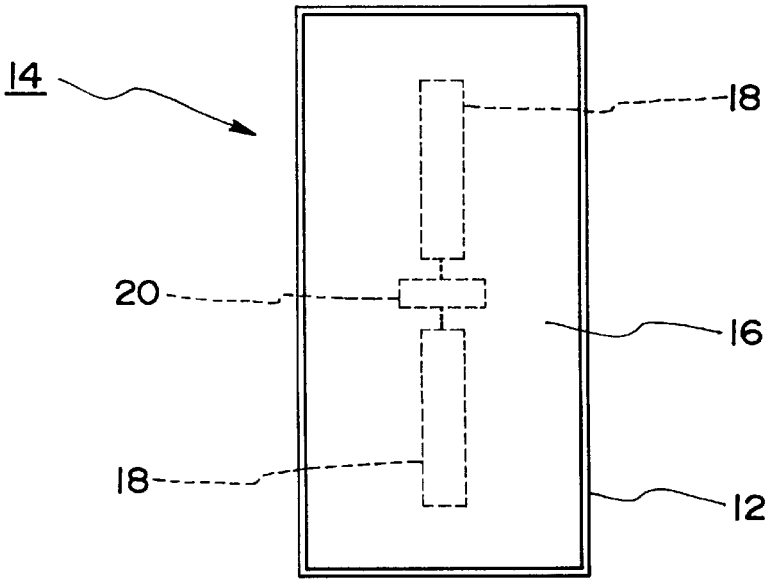
FIG. 2 is a side view of the device according to the present invention.
Figure 3:
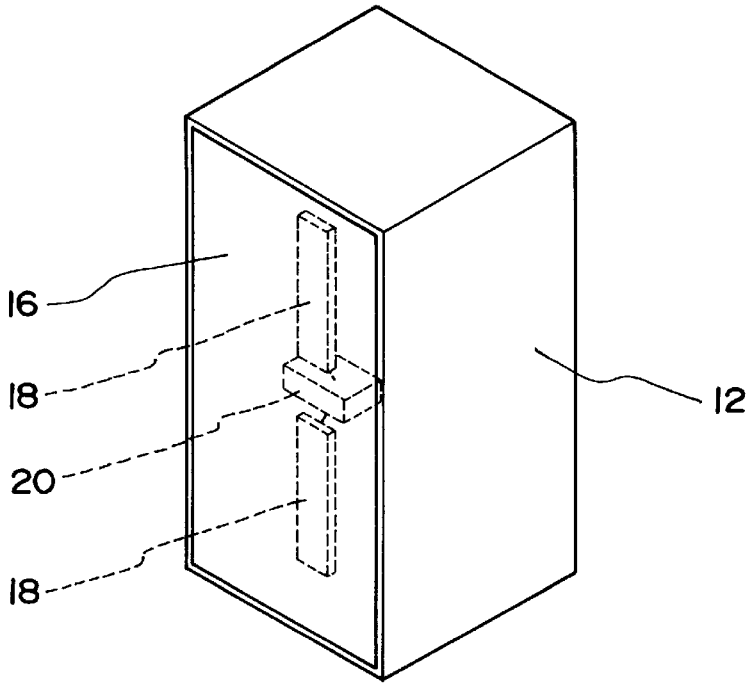
FIG. 3 is an external view of the device according to the present invention.

In FIG. 1, numeral (12) denotes a casing of an underground or underwater antenna (14). The casing is made of a material having good electroconductivity such as aluminum and the like, and its surface is covered with an oxidation preventive treatment. Numeral (16) denotes a high dielectric, and is fixed to an opening portion of the casing (12) in sealed condition by a sealing means such as adhesive, an O-ring and the like. A waterproofing treatment is applied to a joined portion between the casing (12) and the high dielectric (16). The high dielectric (16) is a material whose relative dielectric constant is more than 1, and is made of a high dielectric material having a relative dielectric constant whose value is closer to a relative dielectric constant of a material in which the underground or underwater antenna (14) is buried or that causes such antenna to approach.

For example, in a case where the underground or underwater antenna (14) is buried or where the underground or underwater antenna (14) is caused to approach or contact a concrete structure, or the electromagnetic waves are transmitted to the inside of the concrete structure or the electromagnetic waves from the underground, underwater, concrete structure are received, the dielectric (16) is constructed with a material having a relative dielectric constant whose value is close to a relative dielectric constant of a medium material such as clay, water, sand, concrete and the like that comes into contact with the dielectric (16). Numeral (18) denotes an antenna element, which is fixed to the back surface of the high dielectric (16) by a technique such as metallizing, printing, adhesion and the like. The antenna element (18) is connected to an electric wire (22) made of coaxial cable by means of an impedance matching device (20), and the electric wire (22) is connected to a connector (24) that is mounted on the casing (12). The connector (24) has been treated with a waterproofing treatment. The connector (24) is connected with an electromagnetic wave transmission device or a receiver.

Figure 4:
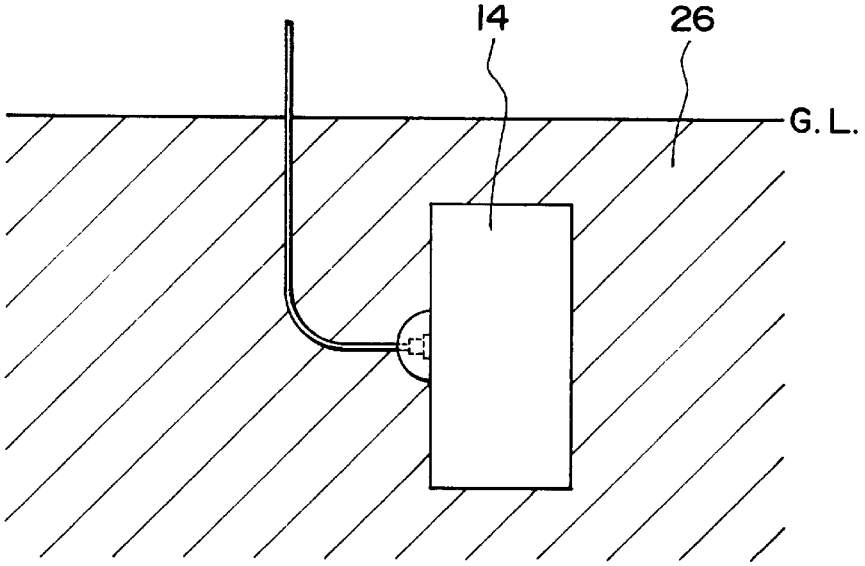
FIG. 4 is an explanatory view of the present invention.

The impedance matching device (20) is mounted on the back surface of the high dielectric (16). The electric wire (22) is so constructed that it goes directly outside through a hole of the casing (12) without involving with the connector (24) depending on the particular usage. In the casing (12), a material body (25) having a sufficiently small relative dielectric constant such as air and the like whose relative dielectric constant is 1 is stored. It is feasible that a filler having a small relative dielectric constant, for example, a silicone rubber whose relative dielectric constant is somewhere in the range of 1 to 3 is filled in the casing (12). In a case where electromagnetic waves are transmitted by the foregoing underground or underwater antenna (14), the underground or underwater antenna (14) is buried in the underground (26) as shown in FIG. 4.

In this case, the high dielectric (16) employs a high dielectric material having a relative dielectric constant whose value is closer to the relative dielectric constant and is smaller than the relative dielectric constant of the sand, mud, rock and the like in the underground (26). The electromagnetic waves have the characteristics of being absorbed by a material body having high relative dielectric constant. The electromagnetic waves released from the antenna element (18), sandwiched between the material body (25) having the small relative dielectric constant and the high dielectric (16) having relative dielectric constant whose value is higher than that of the material body (25) is reflected on the material body (25), and is radiated more by the high dielectric (16) whose relative dielectric constant is higher, and is absorbed into the sand, mud, rock in the underground without resistance, and is propagated. A material body is placed in the casing (12), and the material body has a relative dielectric constant that is close to 1 such as air. Also, the electromagnetic waves are efficiently absorbed into the underground on grounds of reflection action of the inner wall surface **(12*a*) of the casing (12)**.

Furthermore, in case of reception, a method of using a material having a little higher relative dielectric constant than the relative dielectric constant of the material body that comes into contact with the casing (12) is used in producing the high dielectric (16), and fixing the antenna element (18) on the high dielectric makes it easy to absorb the electromagnetic waves coming out from the underground or the underwater. The electromagnetic waves absorbed into the high dielectric (16) is reflected by the material body having small relative dielectric constant or the wall surface **(12*a*) of the casing (12), and much of the electromagnetic waves are absorbed with efficiency by the antenna element (18)**.

Performance Comparison Test

When an experiment was conducted by using a material body of a glass epoxy substrate for a printed substrate having relative dielectric constant of 4.8 and a material body using a material whose relative dielectric constant was 10.5 as the dielectic (16) in the underground, the underground antenna of the latter produced a result of improved performance that was about 10 times as compared with the performance of the prior art underground antenna. The relative dielectric constant of the clay and the like almost 12–15, and the fact that the improved efficiency was obtained by fixing the antenna element on the high dielectric having relative dielectric constant closer to the clay was experimentally confirmed. In the case of transmission, the relative dielectric constant of the dielectric (16) was slightly smaller than the relative dielectric constant of the material body in the underground that came to contact with the dielectric (16), and the in case of reception, it was desirable that the constant was slightly larger, but there was no particular limitation.

Figure 6:
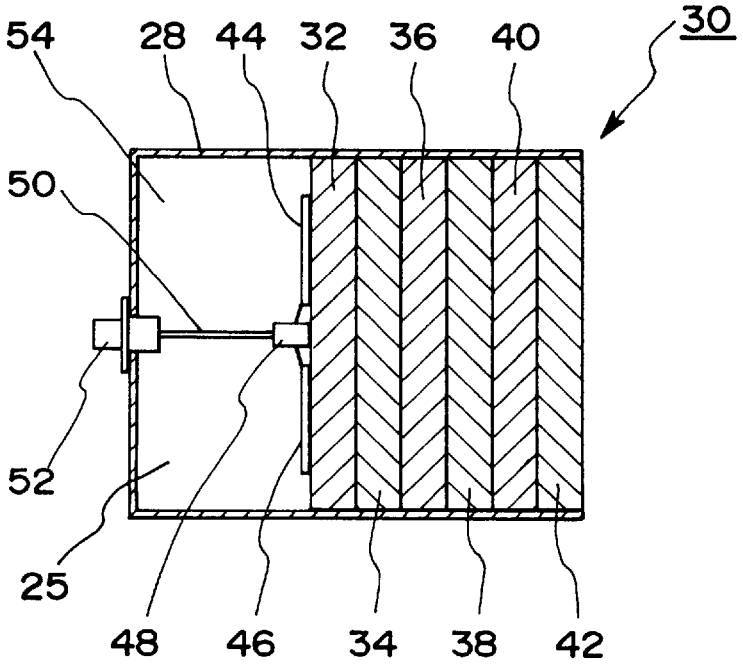
FIG. 6 is a cross section showing another embodiment of the present invention.

Another embodiment of the present invention will be described in the following by referring to FIG. 6. Numeral (28) denotes a casing of a multilayered underground, underwater antenna (30), and was constructed of a material identical with that of the first embodiment of the present invention. In the casing (28), a plurality of high dielectrics (32) (34) (36) (38) (40) were fixed, and these high dielectrics (32) (34) (36) (38) (40) had relative dielectric constants whose values gradually approached the relative dielectric constant of the material outside of the casing (30) in order from left to right in the drawing. In the drawing, numerals (44) and (46) denote antenna elements fixed to the dielectric (32), and numeral (48) denotes an impedance matching device, and numeral (50) denotes an electric wire made from coaxial cable, and numeral (52) denotes a connector, and numeral (54) denotes a material body whose relative dielectric constant was closer to 1 like the air.

Figure 7:
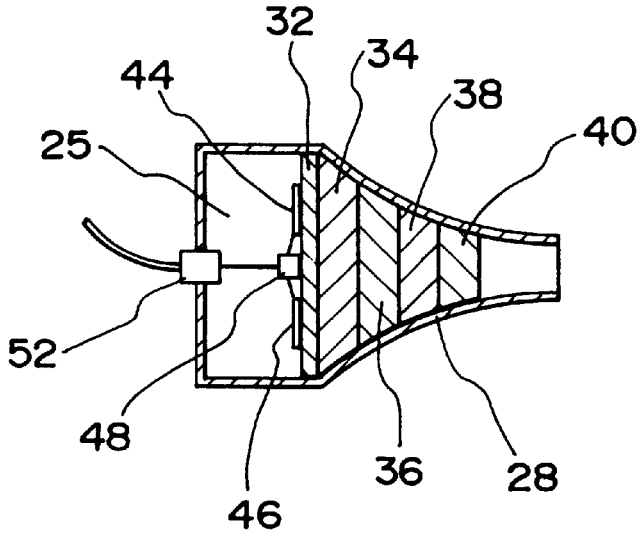
FIG. 7 is a cross section showing another embodiment according to the present invention.
Figure 8:
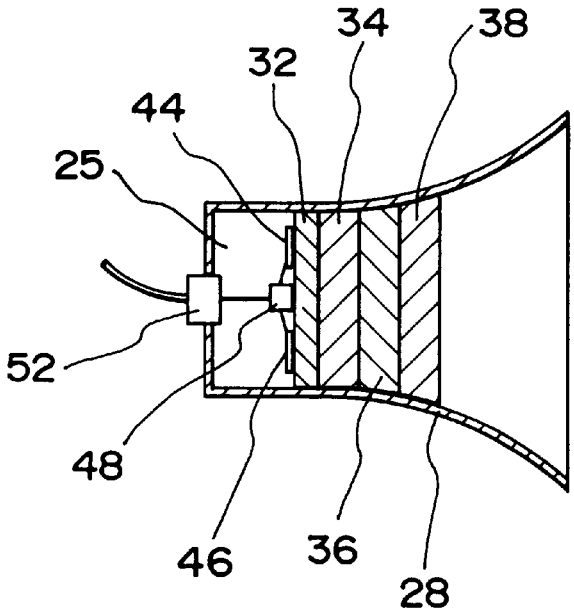
FIG. 8 is a cross section showing another embodiment according to the present invention.
Figure 9:
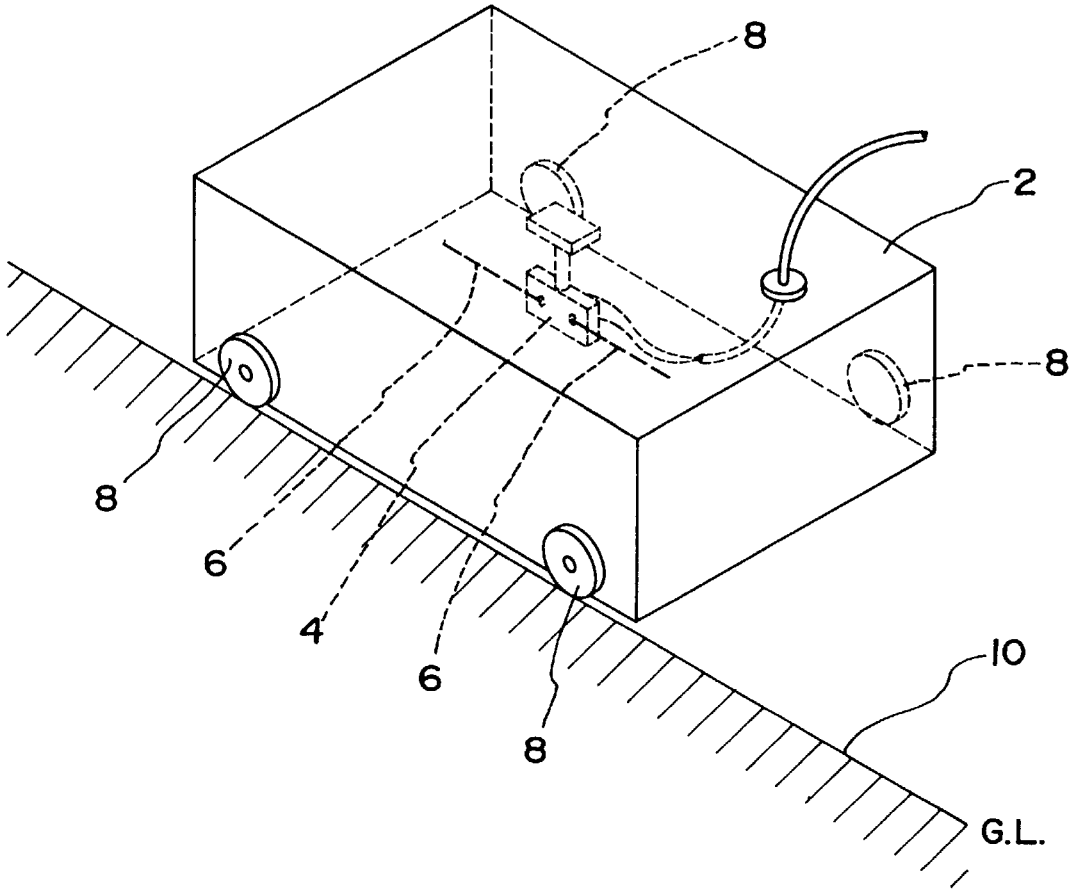
FIG. 9 (PRIOR ART)
FIG. 9 is prospective view of a conventional technique.

It is feasible that when the antenna elements (44) (46) are disposed between the layers of the high dielectrics (32) (34) (36) (38) (40) (42) by changing lengths depending on their uses to facilitate an improvement of performance that brings about an improvement of gain, a broader wide band and better directivity. Furthermore, as shown in FIGS. 7 and 8, concentration of energy of electric waves was caused, or the directivity was improved by forming a tip of the casing (28) into a tapered shape, bugle shape or other variety of shapes. By exerting an effort on the multilayer of the high dielectric, it became feasible to materialize a logarithm function antenna that was frequently used as one of aerial antennas.

The length of the antenna element varied with respect to compaction rate by the value of the relative dielectric constant of the material body that came into contact with the antenna element. In the case of an above-ground antenna, the relative dielectric constant of the vicinity was close to 1, and in general, the rate of compaction was approximately in the range of 80–90%, but in the high dielectric constant, a larger compaction became possible. Under the circumstance, in the low frequency band, the antenna element was fixed to the dielectric having a high dielectric constant, and the antenna element was connected electrically similar to that of the logarithmic function antenna whereby the antenna element could obtain a larger gain, directivity, wide band, and miniaturization.

Figure 5:
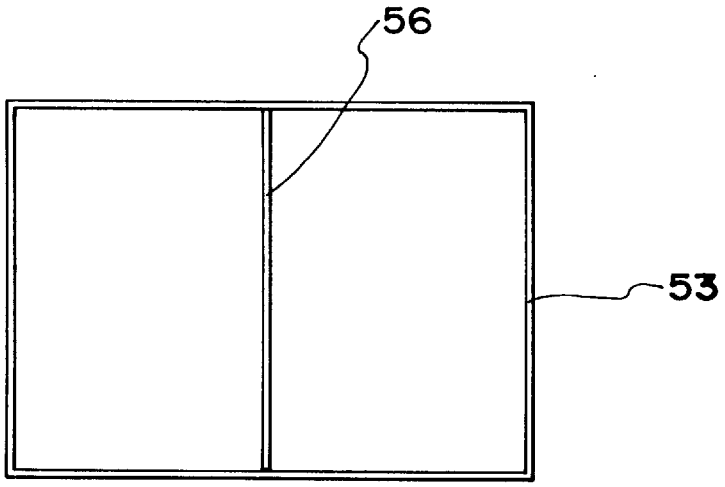
FIG. 5 is a side view showing another embodiment of the present invention.

For reference, in a case in which the present invention is used for radar, as shown in FIG. 5, a partition (56) was provided for a casing (53), and an antenna element for transmission and an antenna element for reception were disposed by sandwiching the partition (56). In FIG. 5, the internal structure of each compartment of the casing (53) sandwiching the partition (56) was identical with the structure of the underground or underwater antenna (14) as shown in FIG. 1. Furthermore, in the case of using the present invention for radar, as shown in FIG. 1, the antenna elements (18) were used as hybrid antenna, and the hybrid antenna might function both for transmission and reception.

For reference, the present invention employs a theory that the electromagnetic wave reflects on a material body of a low relative dielectric constant and is radiated with an efficiency in the direction of the high dielectric having high relative dielectric constant in the arrangement in which antenna element is sandwiched between the low relative dielectric constant material body and the high dielectric of high relative dielectric constant, so that the relative dielectric constant of the material body (25) is not particularly limited to 1, and also, the relative dielectric constant of the high dielectric (25) is not particularly limited.

The result of experiment of the present invention will be described in the following.

An antenna element was sandwiched between a high dielectric (relative dielectric constant 14–15) of relative dielectric constant closer to the relative dielectric constant of clay, sand, water and the like, and a low dielectric (relative dielectric constant 1–5) of relative dielectric constant closer to relative dielectric constant of air, silicone, epoxy and the like, such that an antenna was constructed.

In order to make the gain of the antenna to be constant to the frequency band, a magnetic material such as ferrite and the like was pasted on the upper surface of the antenna. In the experiment, it was done in the condition where a ferrite plate was pasted to the inside of the casing. With this arrangement, a flat gain was achieved which was satisfactory in the range from low frequency to high frequency.

Furthermore, depending on the location where the antenna was installed, it was confirmed that there was a location where the gain was high against a specific frequency or a location where the gain was low on the contrary.

In this experiment, a material prepared by powderizing ferrite and mixing with resin (epoxy, silicone and the like), and this material was utilized as the shell structural material serving as the casing. Furthermore, it was discovered that sintered ferrite could be utilized as the shell structural material.

By the experiment, it became feasible to miniaturize the whole antenna through elimination of the casing. Furthermore, when an adhesive having a high dielectric was pasted to the high dielectric and the antenna was caused to contact the upper surface of the clay or concrete to investigate the inside, the antenna could be easily used.

Figure 10:
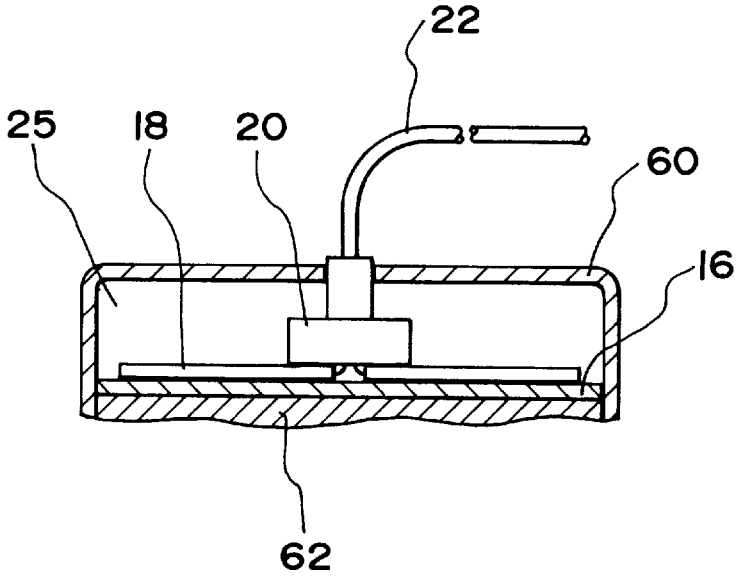
FIG. 10 is a cross section showing another embodiment according to the present invention.

An example of an application of the foregoing experiment will be described by referring to FIG. 10.

The high dielectric (16) was covered with an outer shell (60) made of ferrite. A gel-like material was mounted on the bottom surface of the high dielectric (16). The gel-like material contains water which is an adhesive material (62) such as an adhesive of the high dielectric material. The adhesive (62) is not limited to a gel type adhesive, and a material prepared by placing a gel like fluid into a rubber bag could be used. By this arrangement, the antenna maintained a favorable contact condition with the clay or the concrete. In FIG. 10, numeral (18) denotes an antenna element, numeral (25) denotes a low dielectric, numeral (20) denotes an impedance matching device, and numeral (22) denotes an electric wire. In the case of manufacturing a relatively low cost type antenna, it could be done in such a way that a material made of printed substrate material for electrical use which was available to the public and has a low relative dielectric constant and a material having a value closer to a material to be measured which had a high dielectric constant were used, and an antenna element was sandwiched by those materials such that a thin low cost antenna could be produced. Furthermore, it has been confirmed that characteristics could be improved by attaching a magnetic material such as ferrite on the low dielectric material.

A method of the improving characteristics will be described in the following.

When a gain is maintained constant from a high to a low with respect to a frequency range to be operated, a next processing, for example, at a time of performing an analysis of measurement of strength of signal, there is no need for correction.

Figure 11:
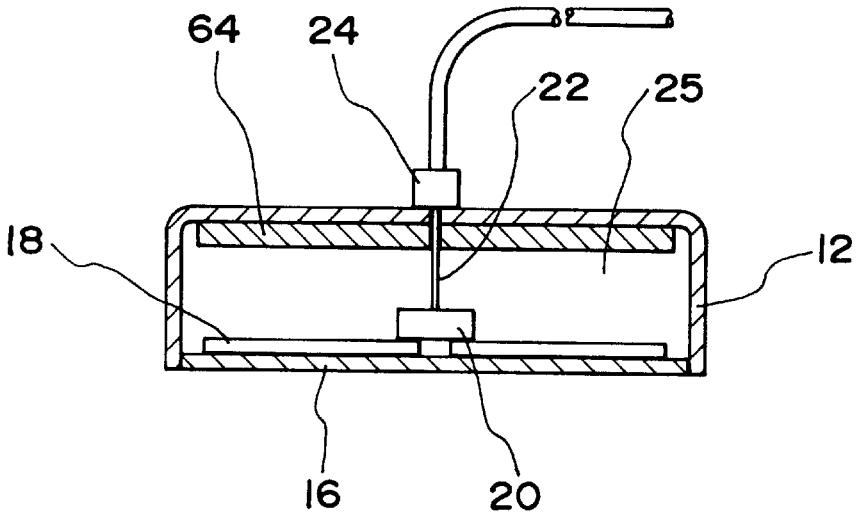
FIG. 11 is a cross section showing another embodiment according to the present invention.

An improvement can be obtained by installing a magnetic material (64), for example, ferrite and the like in the inside of the antenna as shown in FIG. 11. In FIG. 11, numeral (16) denotes a high dielectric, and numeral (12) denotes a casing, and numeral (18) denotes an antenna element, and numeral (25) denotes a low dielectric, and numeral (20) denotes an impedance matching device, and (22) denotes an electric wire.

Figure 12:
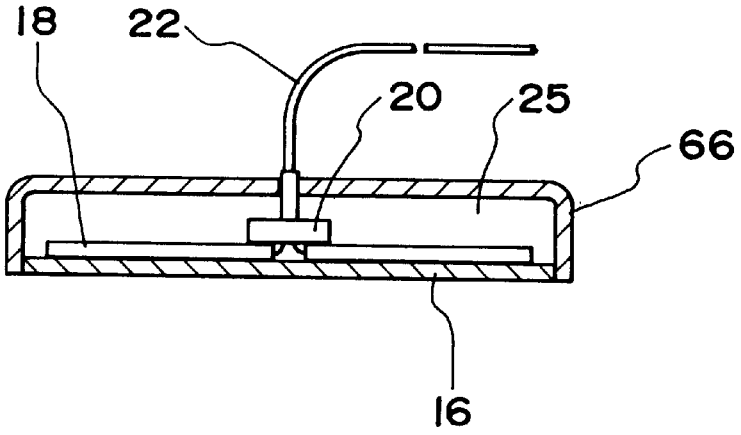
FIG. 12 is a cross section showing another embodiment according to the present invention.

Furthermore, in order to make the whole antenna thinner as shown in FIG. 12, a material was produced by powderizing ferrite and mixing it with resin such as epoxy and the like, and the resulting material was used as an outer shell (66). Furthermore, the outer shell (66) might be produced by firing. In FIG. 12, numeral (16) denotes a high dielectric, and numeral (18) denotes an antenna element, and numeral (25) denotes a low dielectric, and numeral (20) denotes an impedance matching device, numeral (22) denotes an electric wire (cable).

A method of improving the antenna from the view point of its structure will be described in the following.

Figure 13:
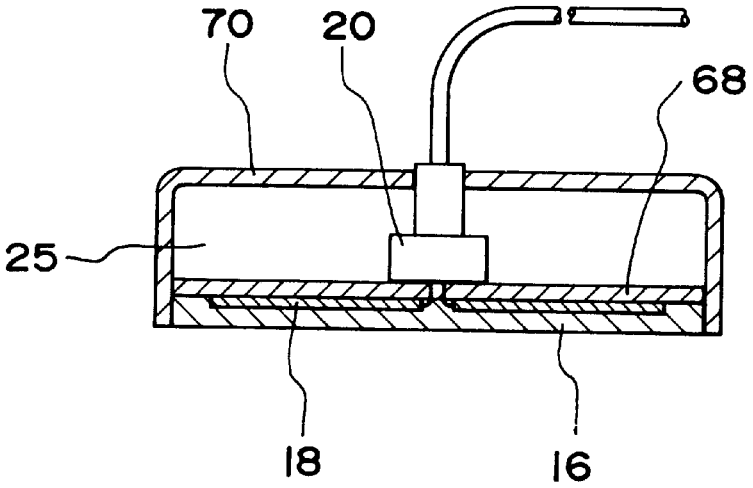
FIG. 13 is a cross section showing another embodiment according to the present invention.

In order to make the thickness of the antenna smaller, as shown in FIG. 13, an antenna element (18) was formed on one surface of a printed substrate (68), made of glass epoxy plate having a small relative dielectric constant, by means of an etching technique, and an impedance matching device (20) and the like is mounted and fixed on the other surface of the printed substrate (68).

A high dielectric (16) is mounted at the side of the antenna element of the printed substrate (68).

The outer shell (70) is constructed by a material prepared by mixing with a magnetic material such as ferrite powder and the like.

When the construction was prepared as shown in FIG. 13, the whole of the antenna was formed with a small thickness.

In this case, when the impedance matching device (20) was installed at an opposite surface of the printed substrate relative to the side where the antenna element (18) was installed, the impedance matching device (20) could be firmly fixed and was free from deterioration of performance due to vibration and the like.

Furthermore, it is feasible to provide a reception amplifier on the printed substrate (68).

Still furthermore, in the structure of FIG. 13, since the antenna element (18) is sandwiched between the high dielectric (18) and the low dielectric made from the printed substrate (68), a sandwich structure of the antenna was completed by this arrangement. Accordingly, the outer shell (70) is not be needed, and in this case, the whole antenna could be formed with a smaller thickness.

Furthermore, another embodiment of the present invention will be described in the following by referring to FIG. 14.

Figure 14:
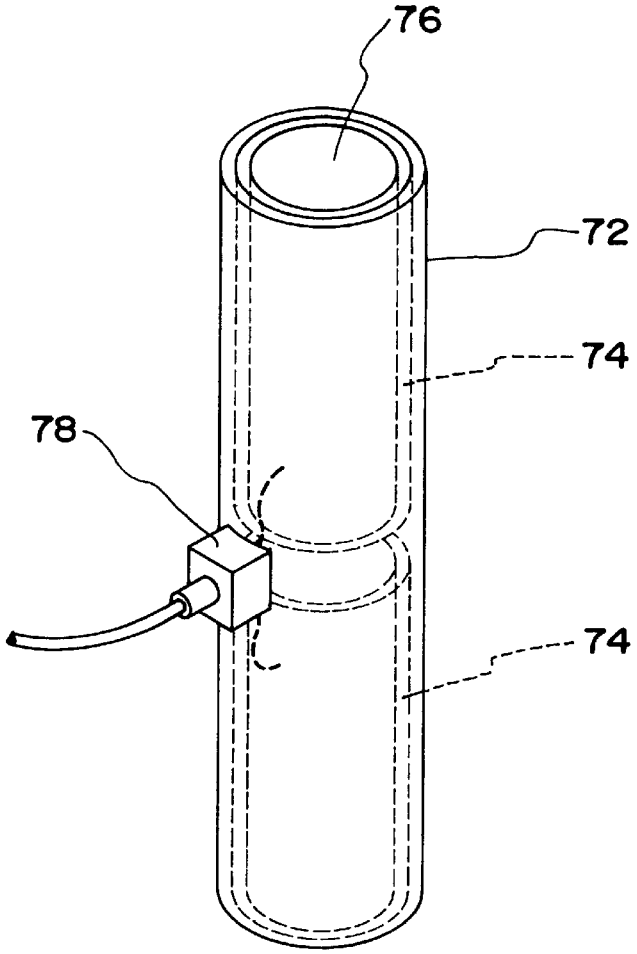
FIG. 14 is an external view showing another embodiment according to the present invention.

In any of the embodiments of the present invention which have been described hereinbefore, the high dielectric was shaped like a plate, but as shown in FIG. 14, the high dielectric (72) can be formed like a tube, and the whole antenna can be shaped like a bar. In FIG. 14, numerals (74) denote a pair of antenna elements that are disposed in the cylindrical high dielectric (72), and the elements were formed in cylindrical form, and a low dielectric (76) such as the air might be filled inside. Numeral (78) denotes, an impedance matching device fixed to the high dielectric (72), and connected to the antenna elements (74) by means of the cable. Both terminals of the high dielectric (72) are sealed by a high dielectric material (not shown in the drawing) or a casing (not shown in the drawing).

Furthermore, in the present invention, the antenna element may be formed as a single unit.

Figure 15:
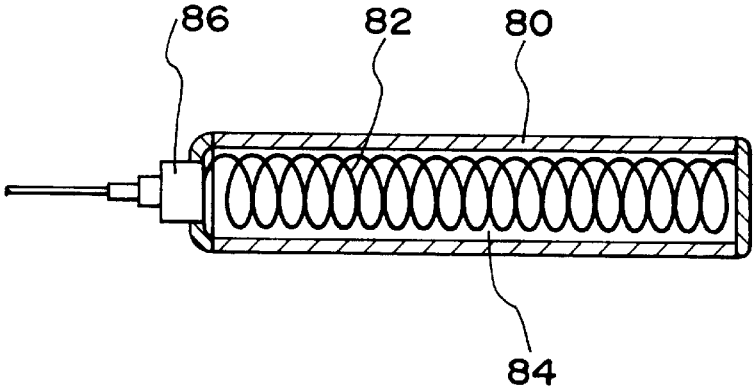
FIG. 15 is a cross section showing another embodiment according to the present invention.

FIG. 15 shows an embodiment in which the antenna element (82) was shaped like a helicoid. Numeral (80) denotes a high dielectric shaped like a cylinder with a bottom. The helical antenna element (82) is fitted and disposed inside of the high dielectric, and the antenna element (82) is connected to the impedance matching device (86) fixed to one end of the high dielectric (80) that forms the outer shell. In the hollow portion of the high dielectric (80), the low dielectric (84) such as the air was filled and disposed. The embodiment shows an example of a modification of the sandwich structure in which the antenna element is sandwiched between the high dielectric and the low dielectric.

Figure 16:
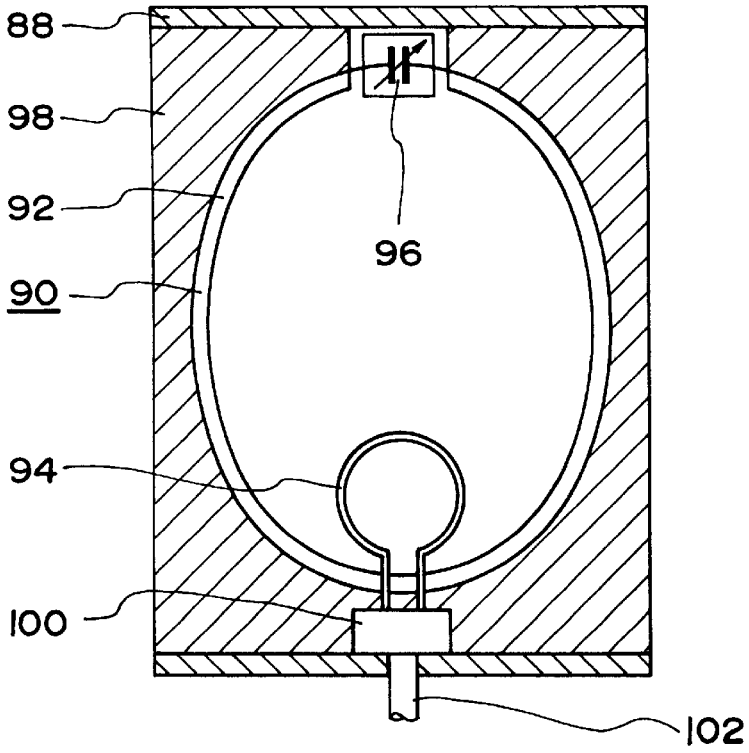
FIG. 16 is a cross section showing another embodiment according to the present invention.
Figure 17:
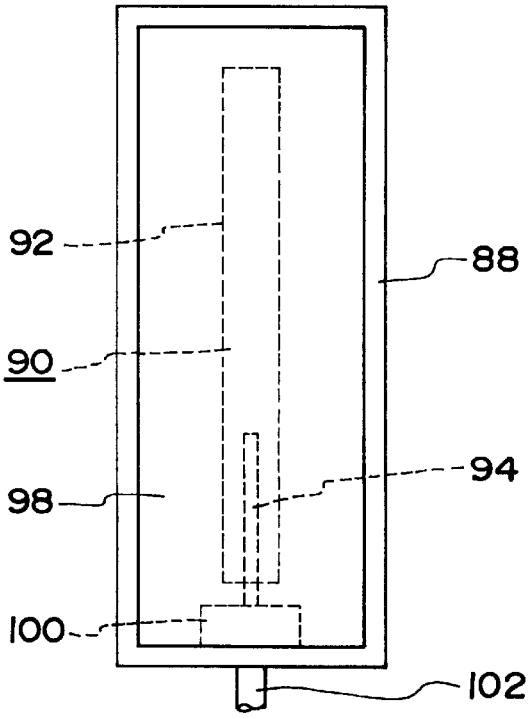
FIG. 17 is a side view showing another embodiment according to the present invention.

In FIGS. 16 and 17, an embodiment using a magnetic field type antenna element is shown. In the drawings, numeral (88) denotes a casing made of a good electroconductive member that is shaped like a tube, and the magnetic field type antenna element (90) is disposed inside.

The magnetic field type antenna element (90) consisted of a pipelike loop coil (92) and a link coil (94) connected to the coil (92). The loop coil (92) is connected to a variable capacitor (96). The casing (88) is filled with the dielectric (98) so that it is in contact with the outside of the loop coil (92). The low dielectric constant material is filled inside of the loop coil (92) or the inside was kept in a condition filled with the air. Numeral (100) denotes an impedance matching device connected to the link coil (94), and numeral (102) denotes a coaxial cable.

What is claimed is:

1. An underground or underwater antenna for transmitting electromagnetic waves to the ground or water or receiving electromagnetic waves from the ground or water, said antenna comprising:

a high dielectric formed from a material having a relative dielectric constant that is close to a relative dielectric constant of a medium material selected from the group of clay, sand, or water in the ground or water;

a low dielectric comprising a body of material having a small relative dielectric constant; and an antenna element sandwiched between said high dielectric and said body of material to produce a sandwich type antenna.

2. An underground or underwater antenna as claimed in claim 1, wherein said high dielectric has the shape of a tube, and said antenna element and said low dielectric are disposed inside of said high dielectric.

3. An underground or underwater antenna as claimed in claim 1, wherein said antenna element comprises a helical antenna element.

4. An underground or underwater antenna as claimed in claim 3, wherein said low dielectric and said helical antenna element are disposed inside of said high dielectric.

5. An underground or underwater antenna as claimed in claim 1, further comprising an adhesive disposed on the surface of said high dielectric.

6. An underground or underwater antenna as claimed in claim 5, wherein said adhesive is a gluing agent.

7. An underground or underwater antenna for transmitting electromagnetic waves to the ground or water and for receiving electromagnetic waves from the ground or water by causing said antenna to be buried in, contact or approach the ground or water, said antenna comprising:

a casing made of a good electroconductive material;

a high dielectric fixed in an opening said casing, said high dielectric being formed of a material having a relative dielectric constant that is close to a relative dielectric constant of a medium material selected from the group of clay, sand, or water found in the ground or water;

an antenna element disposed on a surface of said high dielectric; and a body of material having a small relative dielectric constant disposed in said casing, wherein said antenna element is sandwiched between said body of material having the small relative dielectric constant and said high dielectric.

8. An underground or under water antenna as claimed in claim 7, further comprising a magnetic material disposed inside of said casing.

9. An underground or underwater antenna as claimed in claim 7, further comprising an adhesive disposed on the surface of said high dielectric.

10. An underground or underwater antenna as claimed in claim 9, wherein said adhesive is a gluing agent.

11. An underground or underwater antenna for transmitting electromagnetic waves to the ground or water and for receiving electromagnetic waves from the ground or water by causing said antenna to be buried in, contact or approach the ground or water, said antenna comprising:

an outer shell made of a resin containing ferrite or a ferrite sintered material;

a high dielectric fixed to a side of an opening of said outer shell, said high dielectric being formed of a material having a relative dielectric constant that is close to a relative dielectric constant of clay, sand, or water;

an antenna element disposed on a surface of said high dielectric; and a body of material stored in said outer shell, said body of material having a small relative dielectric constant, wherein said antenna element is sandwiched between said body of material and said high dielectric.

12. An underground or underwater antenna as claimed in claim 11, further comprising:

a printed substrate, formed of a glass epoxy plate, fixed to said high dielectric, wherein said antenna element is formed on a first surface of said printed substrate by an etching technique; and an impedance matching device disposed on a second side of said printed substrate.

13. An underground or underwater antenna as claimed in claim 11, further comprising an adhesive disposed on the surface of said high dielectric.

14. An underground or underwater antenna as claimed in claim 13, wherein said adhesive is a gluing agent.

15. An underground or underwater antenna comprising:

a high dielectric formed of a material having a relative dielectric constant that is close to a relative dielectric constant of clay, sand, water or concrete;

a printed substrate fixed on a side of said high dielectric, said printed substrate being formed of a material having a small dielectric constant; and an antenna element formed on another surface of said printed substrate by means of an etching technique, said antenna element being sandwiched between said high dielectric and said printed substrate.

16. An underground or underwater antenna as claimed in claim 15, wherein said printed substrate comprises a glass epoxy plate.

* * * * *